United States Patent [19]

Stumpf et al.

[11] 3,977,560

[45] Aug. 31, 1976

[54] PRESSURIZED FLUID CONTAINER WITH BUILT IN FILTER

[75] Inventors: Joseph G. Stumpf, Fairfield; Richard L. Testani, Monroe, both of Conn.

[73] Assignee: Frigitronics of Conn., Inc., Shelton, Conn.

[22] Filed: Apr. 17, 1975

[21] Appl. No.: 568,896

Related U.S. Application Data

[63] Continuation of Ser. No. 429,669, Dec. 28, 1973, abandoned.

[52] U.S. Cl. ..... 220/265; 220/371; 210/244; 128/303.1; 62/293; 222/189

[51] Int. Cl.[2] ..... B65D 42/02

[58] Field of Search ..... 210/244, 446, 444, 447, 210/454, 455, 469, 474; 222/5, 189, 541; 220/371, 265, 367; 128/303.1; 62/293

[56] References Cited

UNITED STATES PATENTS

| | | | |
|---|---|---|---|
| 2,558,987 | 7/1951 | Shaw | 210/244 |
| 2,839,056 | 6/1958 | Mailly | 210/454 |
| 3,098,589 | 7/1963 | Graham | 222/189 |
| 3,425,417 | 2/1969 | Kanlar et al. | 128/303.1 |
| 3,760,987 | 9/1973 | Meterhoefer | 222/189 |

*Primary Examiner*—George T. Hall
*Attorney, Agent, or Firm*—Buckles and Bramblett

[57] ABSTRACT

There is disclosed a pressurized Freon cylinder having a cap including a threaded nipple with a puncturable end wall. Positioned within the nipple, by screwing into its internal threads, is a porous plastic filter in the path of the fluid as it leaves the container.

4 Claims, 2 Drawing Figures

PRESSURIZED FLUID CONTAINER WITH BUILT IN FILTER

BACKGROUND OF THE INVENTION

This is a continuation of United States Patent application No. 429,669 filed Dec. 28 1973, now abandoned, by the inventors herein.

One problem encountered by users of cryosurgical instruments operating on fluids such as Freon (a du Pont trademark for monochlorodifluoromethane) is the presence in the fluid of contaminating particles. The most common contaminants are oil and aluminum oxide produced by the filling process and by contaminated containers. The alumina particles tend to collect in the micro orifice of the cryosurgical instrument and restrict the flow of the refrigerant. Upon purging and exhausting, the particles plug the exhaust filter and muffler.

The major use of commercial Freon is in refrigeration systems. Only a relatively small amount is employed for cryosurgical instruments. For this reason, the container manufacturers are not inclined to exercise particular care in their cleaning process. Companies who normally fill the containers add extra charges for special handling to clean them. Even with the added costs and special handling, the aluminum containers will oxidize and form alumina.

Accordingly, the primary object of the present invention is to provide a container with an integral filter. Other objects are to provide such a container wherein the filter is inexpensive, light weight, small is size, and can be installed by unskilled personnel.

SUMMARY OF THE INVENTION

In a normally sealed pressurized fluid container which has a puncturable outlet region in the wall, the improvement comprising a porous filter which is retained within the container adjacent the outlet and is positioned to filter fluid leaving the punctured outlet.

DESCRIPTION OF THE PREFERRED EMBODIMENT

Figure 1:
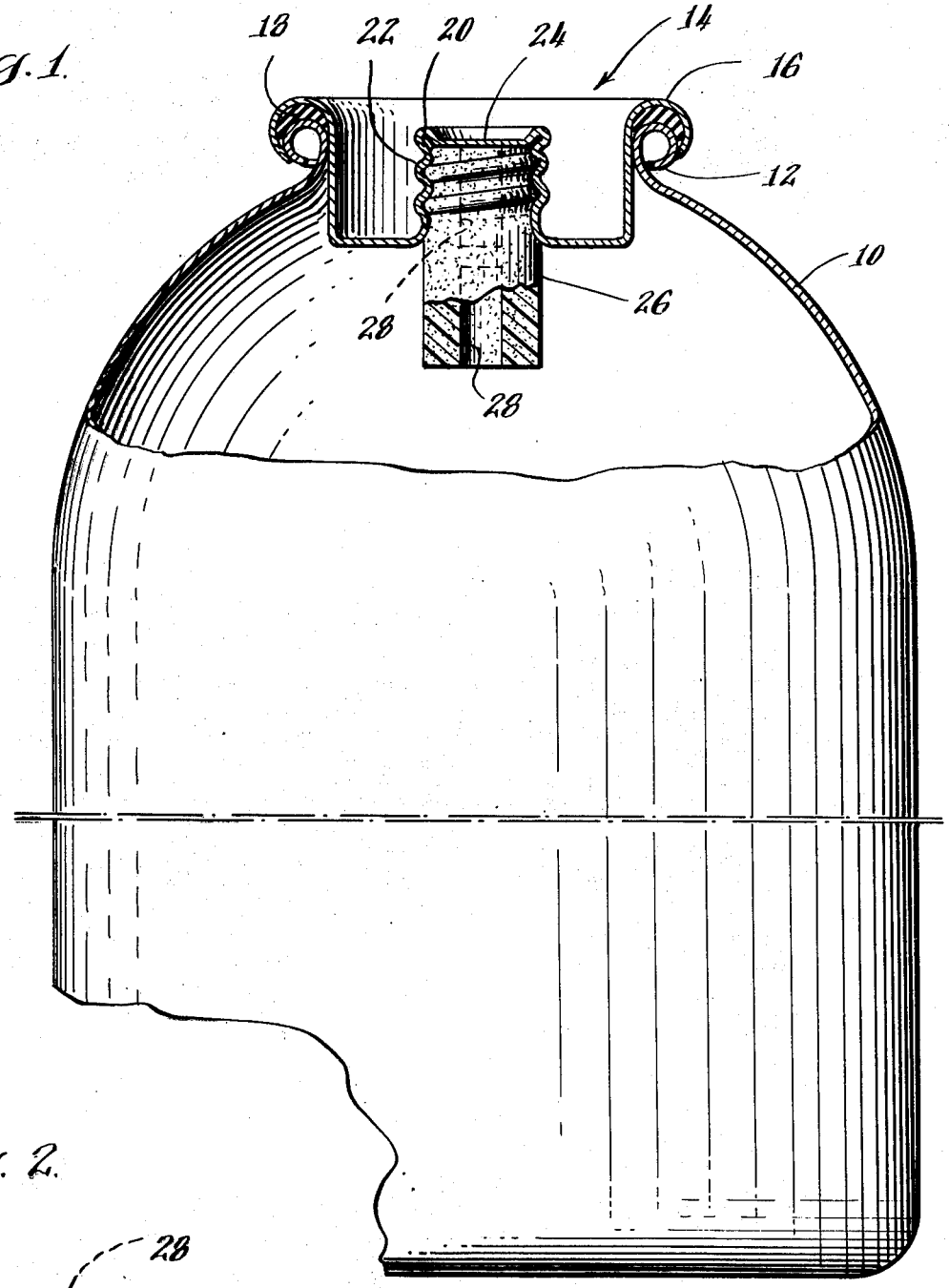
FIG. 1 is an elevational view of a container in accordance with this invention, partially broken away to illustrate its internal construction.
Figure 2:
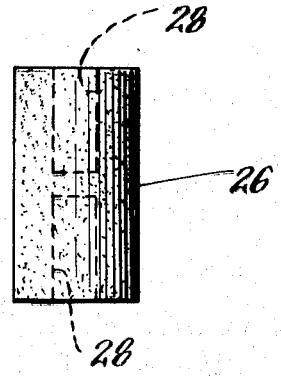
FIG. 2 is an elevational view of a filter usable in the invention.

FIG. 1 illustrates a container of the type normally used to store fluid refrigerants. It comprises an aluminum can 10 having a mouth defined by a circular rim 12. The mouth is closed by a cap 14 which is essentially cup shaped and includes an outer flange 16 which is crimped over rim 12. A rubber washer 18 forms a fuid-tight seal between the cap and the container. At its center the cap 14 defines a raised nipple 20 having external threads 22. The metal wall at the end of nipple 20 includes a thin walled puncture region 24.

The container described above is conventional and is used, for example, as a source of Freon for cryosurgical instruments. In use, the container inverted and the nipple 22 is screwed into a threaded socket in a fluid delivery system. A hollow needle in the delivery system punctures the puncture region 24 and the refrigerating fluid is then delivered by suitable piping and valving to the cryosurgical instrument.

In order to remove the contaminating particles previously referred to, there is provided a cylindrical filter 26 formed of a suitable filter material such as porous polyethylene. Suitable porous plastics are available from Porex Materials Corporation, Fairburn, Georgia. Porous high density polyethylene with a pore size of, for example, 10 microns has been found to be suitable for filtering Freon for cryosurgical instruments. The filter defines a recess 28 at each end thereof.

Due to the thin wall construction of the cap 14, the threads 22 on the exterior surface of nipple 20 are also present on its interior surface. This means that an unskilled worker can easily thread the relatively soft filter 26 into the interior of the nipple prior to final assembly of the can 10 and cap 14. The recess 28 permits entry of the hollow needle and, by forming such a recess in both ends of the filter, it does not matter which end of the filter is screwed into the nipple.

By means of the present invention, all of the objectives hereinbefore set forth are achieved. No special care need be taken in either cleaning the cans prior to filling or in the filling process, yet the final consumer is assured of a supply of substantially contaminant free refrigerant. Futhermore, these desirable objectives are achieved at minimal cost, both in labor and materials. It will also be apparent to those skilled in the art that a number of variations and modifications may be made in this invention without departing from is spirit and scope. Accordingly, the foregoing description is to be construed as illustrative only, rather than limiting. This invention is limited only by the scope of the following claims.

We claim:

1. A container for fluid refrigerants which comprises: a substantially cylindrical can having an open mouth concentric therewith; a normally non-removable cap closing said mouth and defining a hollow thin wall, cylindrical nipple concentric with said mouth and cap, extending outwardly therefrom and including a needle-pierceable end wall, the cylindrical wall of said nipple being deformed to simultaneously define complementary external and internal threads thereon; and a cylindrical porous filter within said nipple in threaded engagement with said internal threads in the path of refrigerant discharged from said container through the pierced end wall.

2. The container of claim 1 wherein said filter defines an axial recess adjacent said end wall.

3. The container of claim 1 wherein said filter is porous plastic.

4. The container of claim 2 wherein said filter is porous plastic.

* * * * *